US007558516B2

(12) United States Patent
Fukuda et al.

(10) Patent No.: US 7,558,516 B2
(45) Date of Patent: Jul. 7, 2009

(54) IMAGE FORMING APPARATUS WHEREIN A CARRIER WEIGHT RATIO IN A FIRST SUPPLY CONTAINER AND CARRIER WEIGHT RATIO IN A SECOND SUPPLY CONTAINER ARE SUBSTANTIALLY EQUAL TO EACH OTHER

(75) Inventors: Tadashi Fukuda, Toride (JP); Tadayoshi Nishihama, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 11/626,066

(22) Filed: Jan. 23, 2007

(65) Prior Publication Data

US 2007/0172260 A1 Jul. 26, 2007

(30) Foreign Application Priority Data

Jan. 24, 2006 (JP) ..... 2006-015643

(51) Int. Cl.
*G03G 15/16* (2006.01)
*G03G 15/01* (2006.01)

(52) U.S. Cl. ..... 399/296; 399/223

(58) Field of Classification Search ..... 399/27, 399/30, 58, 223, 227, 258, 259, 296, 341
See application file for complete search history.

(56) References Cited

U.S. PATENT DOCUMENTS

| | | | | |
|---|---|---|---|---|
| 4,731,313 | A * | 3/1988 | Haneda | 399/223 X |
| 5,179,414 | A * | 1/1993 | Bhagat | 399/258 |
| 5,260,753 | A | 11/1993 | Haneda et al. | |
| 5,751,432 | A * | 5/1998 | Gwaltney | 358/296 |
| 6,678,493 | B2 * | 1/2004 | Maeyama et al. | 399/223 X |
| 6,847,797 | B2 | 1/2005 | Nishihama et al. | |
| 6,987,942 | B2 * | 1/2006 | Yoshikawa et al. | 399/258 |
| 7,016,621 | B1 * | 3/2006 | Ng | 399/296 X |
| 2005/0214669 | A1 * | 9/2005 | Hayashi et al. | 399/341 X |
| 2006/0140651 | A1 | 6/2006 | Hirobe et al. | |
| 2006/0198661 | A1 | 9/2006 | Nishihama et al. | |

FOREIGN PATENT DOCUMENTS

| | | |
|---|---|---|
| JP | 4-278967 | 10/1992 |
| JP | 5-6033 | 1/1993 |
| JP | 5-127437 | 5/1993 |
| JP | 2000-147863 | 5/2000 |

* cited by examiner

*Primary Examiner*—Sandra L Brase
(74) *Attorney, Agent, or Firm*—Fitzpatrick, Cella, Harper & Scinto

(57) ABSTRACT

An image forming apparatus includes a first developing device for developing an electrostatic image with a first developer including a non-transparent toner and a carrier; a second developing device for developing an electrostatic image with a second developer including transparent toner and carrier; a first supplying device for supplying a first supply developer including non-transparent toner and a carrier to the first developing device; a first supplying device for supplying a second supply developer including transparent toner and a carrier to the second developing device; a control device for superimposing a toner image of the transparent toner on the non-transparent toner image so as to reduce a height difference in toner layer or layers of the toner image provided by the non-transparent toner, wherein a carrier weight ratio in the first supply developer and a carrier weight ratio in the second supply developer are substantially equal to each other.

6 Claims, 5 Drawing Sheets

IMAGE FORMING APPARATUS WHEREIN A CARRIER WEIGHT RATIO IN A FIRST SUPPLY CONTAINER AND CARRIER WEIGHT RATIO IN A SECOND SUPPLY CONTAINER ARE SUBSTANTIALLY EQUAL TO EACH OTHER

FIELD OF THE INVENTION AND RELATED ART

The present invention relates to an image forming apparatus used as an electrophotographic type or electrostatic recording type image forming apparatus such as a copying machine, a printer, or the like. More specifically, the present invention relates to an image forming apparatus for forming an image with the use of a color toner and a transparent toner.

In a conventional image forming apparatus of, e.g., an electrophotographic type, particularly an image forming apparatus for effecting formation of a chromatic color image, a two component developing method using a two component developer, as a developer, principally comprising a mixture of nonmagnetic toner (toner) and a magnetic carrier (carrier) has been widely used.

The two component developing method has advantages such as stability of image quality and durability of an apparatus in long-term use compared with other developing methods such as one component dry developing method.

Particularly, in recent years, a demand for a stable output of a high-quality image with a minimized downtime (during which the image cannot be outputted due to a preparatory/adjusting operation) has grown in a POD (print on demand) market in the case of an electrophotographic image forming apparatus using the two component developing method.

Further, for example, in an ink jet image forming apparatus, output of a photo-like image using inks of five or more colors has been commonly performed. In the electrophotographic image forming apparatus, techniques for enhancing image quality wherein a gradation performance at a halftone portion is enhanced by multi-color development (development with five or more colors) or a surface gloss is increased by fixing transparent toner on an uppermost layer have been proposed.

For example, Japanese Laid-Open Patent Application (JP-A) No. Hei 4-278967 has proposed a technique for increasing gloss at an image surface by effecting development with transparent toner on an entire surface of an image forming area. According to this technique, it has been said that it is possible to provide a color image having a hue close to that of silver halide photography. However, only by effecting development with the transparent toner in a uniform amount on the entire surface of image forming area, a portion with a large coverage of toner and a portion with a small coverage of toner result in portions differing in height, thus leading to an occurrence of projections and recesses. For this reason, although gloss is improved by the transparent toner, due to the occurrence of projections and recesses, a gloss characteristic is not uniform, so that a resultant image can be rather noticeable in terms of nonuniform gloss.

In view of this problem, JP-A Nos. Hei 5-6033, Hei 5-127437, and 2000-147863 have proposed such a method that not only the gloss is improved but also a coverage of transparent toner is adjusted by effecting development with the transparent toner in an entire image forming area. According to this method, it is possible to form a surface with a uniform surface property, so that an image closer to an image formed by silver halide photography can be formed with less projections and recesses caused by deposition of toner.

However, in order to form the above-described image free from projections and recesses, it is desirable that development is effected while adjusting coverages of color toner and transparent toner with high accuracy. When the respective coverages of the color toner and the transparent toner are not accurately adjusted, portions differing in height due to a difference in toner coverage result in projections and recesses at an image surface.

The present inventors have found that an influence of a change in charge amount of the toner by toner supply cannot be negligible in a case of accurately adjusting toner coverage. An influence of the supply toner on a charge amount of toner has not been conventionally considered at all in the case where an image is formed by using color toner and transparent toner.

SUMMARY OF THE INVENTION

Accordingly, it is a principal object of the present invention to provide an image forming apparatus in which an image is formed using non-transparent toner and transparent toner, wherein unevenness of the toner deposition amount is reduced with a simple structure.

According to an aspect of the present invention, there is provided an image forming apparatus comprising first developing means for developing an electrostatic image with a first developer including non-transparent toner and a carrier; second developing means for developing an electrostatic image with a second developer including transparent toner and a carrier; first supplying means for supplying a first supply developer including non-transparent toner and a carrier to said first developing means; first supplying means for supplying a second supply developer including transparent toner and a carrier to said second developing means; control means for superimposing a toner image of the transparent toner on the non-transparent toner image so as to reduce a height difference in toner layer or layers of the toner image provided by the non-transparent toner, wherein a carrier weight ratio in said first supply developer and a carrier weight ratio in said second supply developer are substantially equal to each other.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described more specifically with reference to the drawings.

Embodiment 1

[General Constitution and Operation of Image Forming Apparatus]

Figure 1:
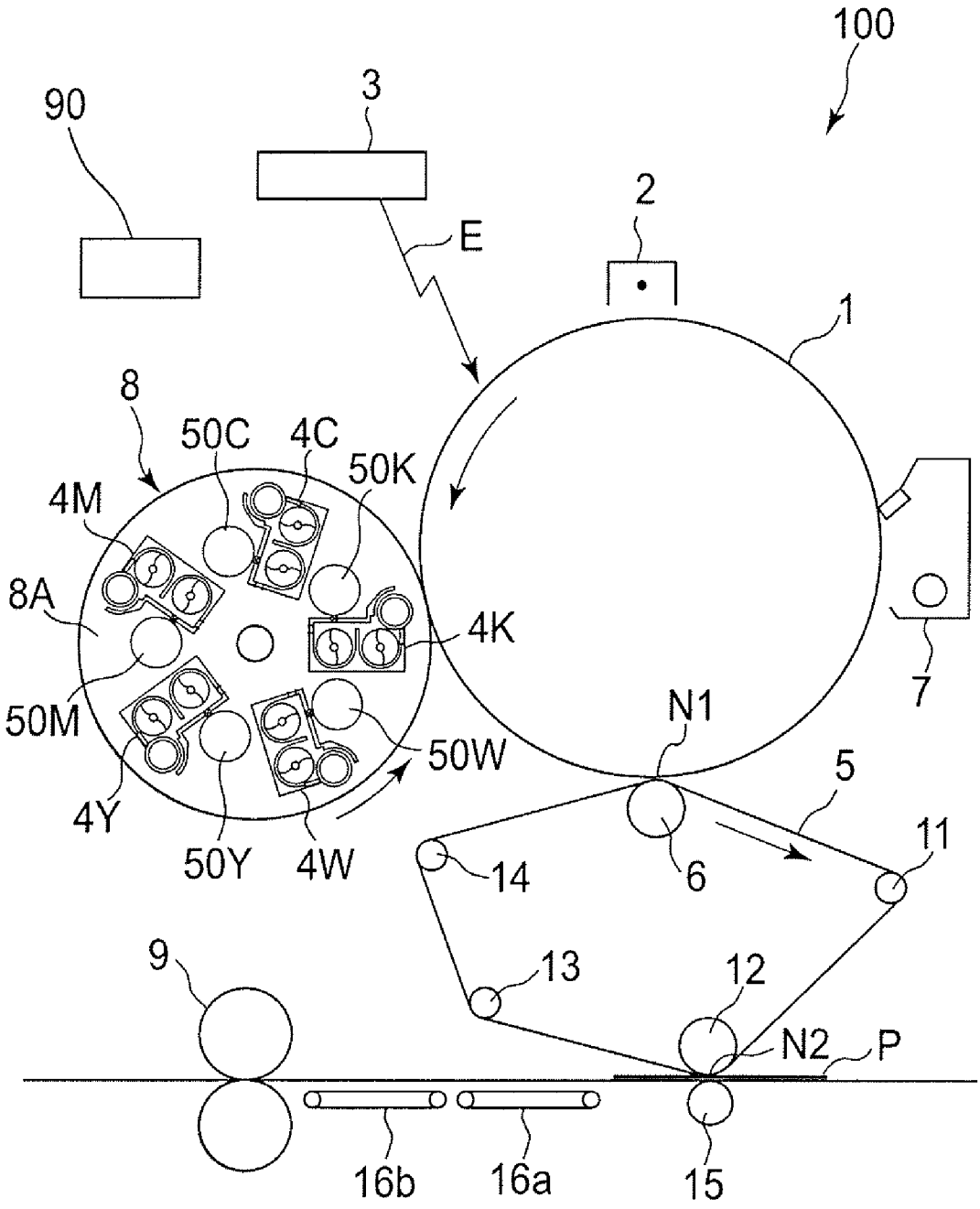
FIG. 1 is a schematic sectional view of an image forming apparatus according to an embodiment of the present invention.

First, a general constitution and operation of an image forming apparatus will be described. FIG. 1 shows a schematic constitution of an image forming apparatus 100 of this embodiment. The image forming apparatus of this embodiment is a full-color laser beam printer capable of forming a full-color image on a recording material, such as a recording sheet, an OHP sheet, or a cloth, in an electrophotographic manner in accordance with an image information signal. The image information signal is sent from external equipment such as a personal computer communicably connected to a main assembly of the image forming apparatus.

The image forming apparatus 100 includes a drum-like electrophotographic photosensitive member, i.e., a photosensitive drum 1 as an image bearing member. Around the photosensitive drum 1, a charger 2 as a charging means, a laser exposure apparatus as an exposure means, a cleaner 7 as a cleaning means, and a rotary developing apparatus 8 are disposed. Further, opposite to the photosensitive drum 1, an intermediary transfer belt 5 as an intermediary transfer member is disposed. The intermediary transfer belt 5 is extended around a drive roller 11, tension rollers 13 and 14, a primary transfer roller 6, and a secondary transfer opposite roller 12.

The rotary developing apparatus 8 includes a rotation member 8A which is disposed opposite to the photosensitive drum 1 and is a rotatably supported developing device supporting member (hereinafter referred to as a "developing rotary"). On the developing rotary 8A, a plurality of developing means developing devices 4Y, 4M, 4C and 4K for four colors of yellow, magenta, cyan, and black, respectively, and a developing device 4W for transparent toner.

For example, during full-color image formation, the photosensitive drum 1 is electrically charged first at its surface by the charger 2. The charged surface of the photosensitive drum 1 is exposed to a light image E emitted from the laser exposure apparatus 3 to form thereon an electrostatic image (latent image). The latent image is developed by the rotary developing apparatus 8. More specifically, the developing rotary 8A is rotated in a direction of an indicated arrow to be moved to a developing position where a predetermined developing device, e.g., the developing device 4K is disposed opposite to the photosensitive drum 1. At the developing position, the developing device 4K is actuated to form a developer image i.e., a toner image on the photosensitive drum 1.

Thereafter, the toner image formed on the photosensitive drum 1 is transferred onto the intermediary transfer belt 5 by the action of the primary transfer roller 6 as a primary transfer means at an opposite portion (primary transfer portion) N1 where the photosensitive drum 1 and the intermediary transfer belt 5 are located opposite to each other. At this time, to the primary transfer roller 6, a primary transfer bias having a predetermined polarity opposite from a normal charge polarity of the toner is applied from a primary transfer bias power source (not shown) as a primary transfer bias generation means.

Figure 4:
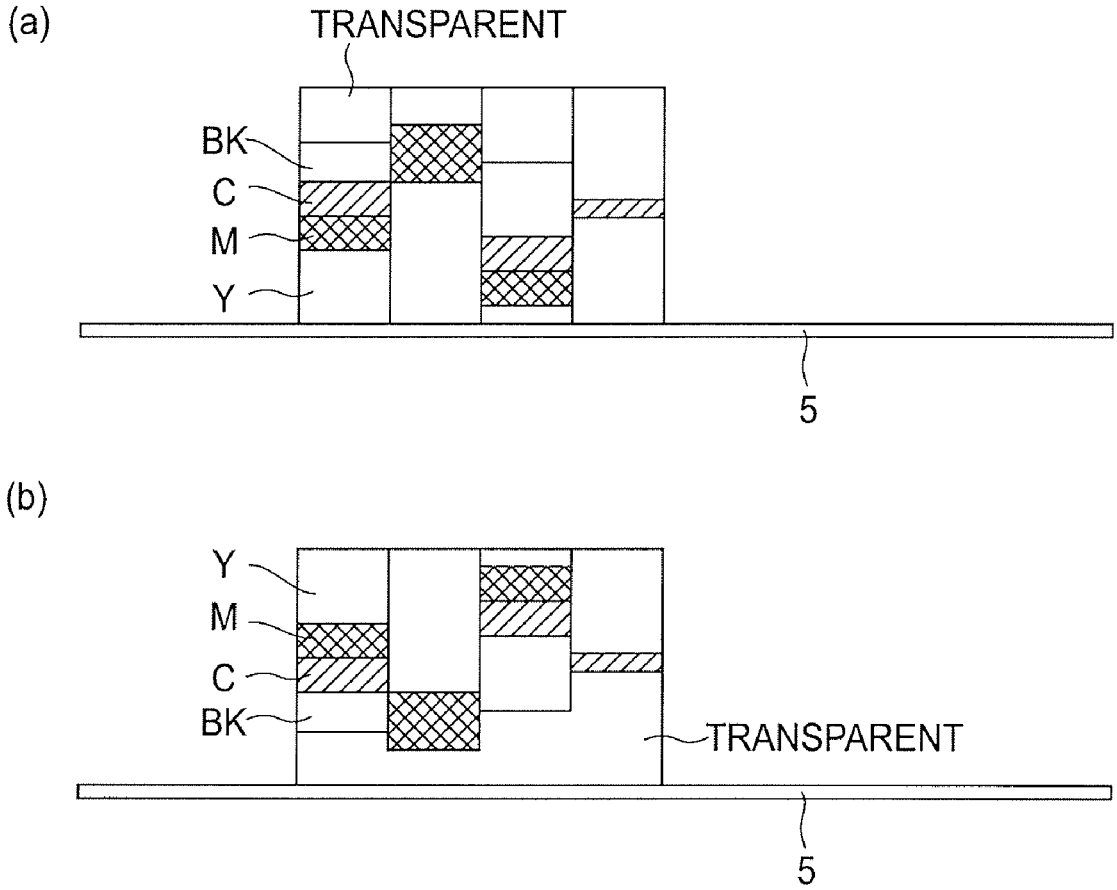
FIG. 4 is a schematic view of an example of images formed using transparent toner.

For example, during the full-color image formation, the above-described operations are repeated to form on the intermediary transfer belt 5 a multi-color toner image comprising yellow toner, magenta toner, cyan toner, black toner, and transparent toner which are successively deposited in a superposition manner. For example, as shown in FIG. 4(*a*) which schematically illustrates a cross section of a multi-color toner image, in order to place a layer of the transparent toner as an underlying layer on the recording material P, it is possible to form the image by transferring toners in the order of yellow toner, magenta toner, cyan toner, black toner and transparent toner onto the intermediary transfer belt 5. Further, e.g., as shown in FIG. 4(*b*) which schematically illustrates a cross section of a multi-color toner image, in order to improve gloss by disposing the transparent toner at an outermost surface of the recording material P, it is also possible to form the image by transferring toners in the order of transparent toner, black toner, cyan toner, magenta toner, and yellow toner.

In either case of the images shown in FIG. 4(*a*) and 4(*b*), the transparent toner is subjected to development and transfer in an amount (coverage) varying depending on coverage of color toners on an entire surface of an image formable area in order to form a multi-color toner image having a flat surface so as to improve gloss and smoothness. Specifically, the coverage of transparent toner is increased in an area with less coverage of the color toners and is decreased in an area with much coverage of the color toner. As is easily understood by a person skilled in the art, the coverages of the color toners and the transparent toner in the image formable area can be determined from an image information signal. Incidentally, the order of the transparent toner and the color toners which are subjected to development and transfer can be appropriately changed as desired. The above-described control such that the transparent toner is superposed so as to decrease a difference in height of the color toner images is effected by a control means 90.

Next, the multi-color toner image formed on the intermediary transfer belt 5 is transferred onto the recording material P by the action of a secondary transfer roller 15 as a secondary transfer means at an opposite portion (secondary transfer portion) N2 where the secondary transfer roller 15 and the intermediary transfer belt 5 are located opposite to each other. In this embodiment, at this time, a predetermined secondary transfer bias is applied from a secondary transfer bias power source (not shown) as a secondary transfer bias generation means to the secondary transfer roller 15. As a result, at the secondary transfer portion N2, an electric field is generated in a direction such that the toner is to be moved from the intermediary transfer belt 5 toward the recording material P.

The recording material P is conveyed from a recording material supply portion (not shown) to the secondary transfer portion N2 in synchronism with a timing of conveyance, to the secondary transfer portion N2, of a leading edge of the multi-color toner image on the intermediary transfer belt 5 in a movement direction.

The recording material P onto which the toner image is transferred is conveyed to a roller fixing device 9 as a fixing means by conveyance belts 16*a* and 16*b*. The recording material P is pressed and heated by the roller fixing device 9, so that the toner image is fixed on the recording material P as a permanent image. Thereafter, the recording material P is discharged outside the image forming apparatus.

Further, primary transfer residual toner remaining on the photosensitive drum 1 after the primary transfer step is collected by a cleaner 7. Secondary transfer residual toner remaining on the intermediary transfer belt 5 after the secondary transfer step is collected by a transfer belt cleaner (not shown).

[Developing device]

Next, the developing devices 4Y, 4M, 4C, 4K, and 4W will be specifically described with reference to FIG. 2. In this embodiment, the respective developing devices 4Y, 4M, 4C, 4K and 4W have the substantially same constitution except that colors of the toners used are different from each other. Hereinbelow, in the case where these developing devices do not require a particular distinction, they are described as a whole by omitting reference characters, Y, M, C, K, W each given for representing the carrier of toner used in an associated developing device.

The developing device 4 includes a developer container 41 in which a two component developer (developer) principally comprising nonmagnetic toner (toner) and a magnetic carrier (carrier) is accommodated. The developer container 41 has an opening 41*a* in an area where the developer container 41 and the photosensitive drum 1 are opposite to each other. At the opening 41*a*, a developing sleeve 42 as a developer carrying member (developing member) is partially exposed and rotatably disposed.

The developing sleeve 42 is constituted by a nonmagnetic material and contains therein a fixed magnet 43 as a magnetic field generation means. Further, in the developer container 41, first and second stirring screws 45 and 46 as a developer stirring and conveying member are provided. A two component developer T in the developer container 41 is circulated and conveyed in the developer container 41 while being stirred by the first and second stirring screws 45 and 46.

Figure 2:
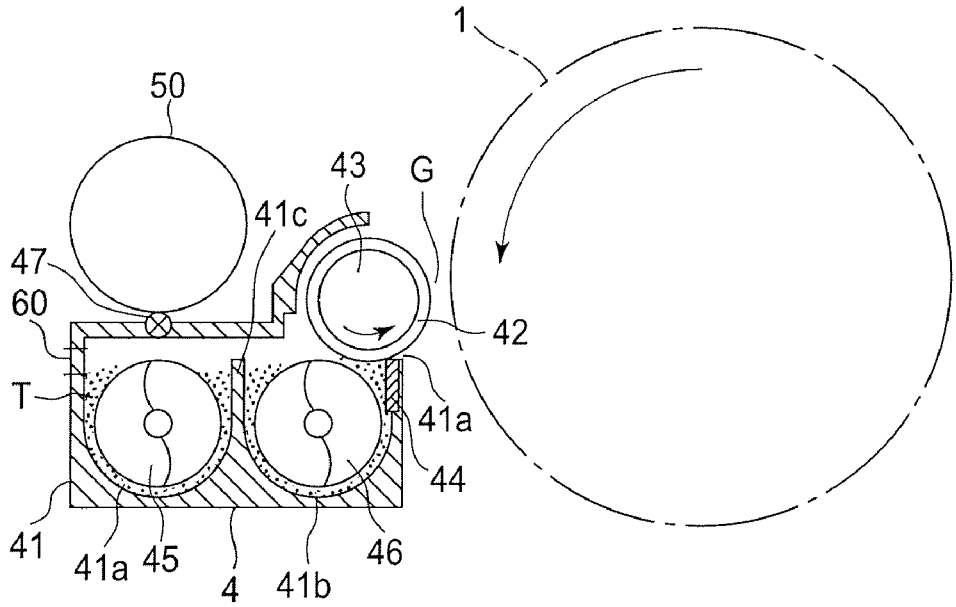
FIG. 2 is a sectional view of a developing apparatus provided in the image forming apparatus of FIG. 1.

During a developing operation, the developing sleeve 42 is rotated in a (counterclockwise) direction shown by an arrow in FIG. 2. In this embodiment, the developing sleeve 42 and the photosensitive drum 1 are rotated in opposite surface movement directions at opposite portions therebetween. The rotating developing sleeve 42 carries and conveys the two component developer T in the developer container 41. More specifically, the carrier on which triboelectrically charged toner is deposited at its surface is constrained and conveyed on the developing sleeve 42 by a magnetic field generated by the magnet 43. By the rotation of the developing sleeve 42, an amount of the two component developer T on the developing sleeve 42 is regulated by a blade 44 as a developer regulation member, so that the two component developer T is formed in a layer. The thus formed layer-like two component developer T is conveyed to a developing area G, where the developing sleeve 42 is opposite to the photosensitive drum 1, by the rotation of the developing sleeve 42. In the developing area G, depending on an electrostatic image on the photosensitive drum 1, toner is supplied from the two component developer to the photosensitive drum 1. As a result, the electrostatic image formed on the photosensitive drum 1 is developed as a toner image. The developer on the developing sleeve 42 after the electrostatic image is developed is conveyed by the rotation of the developing sleeve 42 to be collected in the developer container 41.

To the developing sleeve 42, a predetermined developing bias is applied from a developing bias power source (not shown) as a developing bias generation means. In this embodiment, a developing bias comprising a DC voltage biased with an AC voltage. A waveform of the AC component of the developing bias is a rectangular wave having a frequency of 2 kHz and a peak-to-peak voltage Vpp of 2 kV. As a result of developing bias, an AC electric field is created between the developing sleeve 42 and the photosensitive drum 1, so that the toner is electrically removed from the carrier to form a toner mist. As a result, developing efficiency is improved.

Here, the two component developer will be further described. As the color toners, it is possible to suitably use particles obtained by kneading a pigment in a resinous binder principally comprising, e.g., polyester and pulverizing and classifying the kneaded resinous material. Further, as the transparent toner, it is possible to use particles which comprise a resinous material having a high optical transparency and containing substantially no coloring material and having an average particle size of 1-25 μm and such a property that they are substantially colorless and more transparent to visible light without substantially scattering at least the visible light.

Further, as desired, it is possible to add any component to the developer. For example, when a material selected from waxes, fatty acids, and metal salts of fatty acids is added, a uniform film is liable to be formed during hot melting of the transparent toner at the time of fixation. As a result it is possible to obtain a color image improved in transparency and excellent in surface gloss. Further, during fixation by a hot roller, it is also possible to achieve an effect of preventing offset. In addition, it is possible to add an external additive such as silica, alumina, titania, organic resin particles, or the like, in order to ensure flowability of toner and an electric charge imparting property to the toner.

The carrier can suitably comprise, e.g., particles which are prepared by coating a core material principally comprising ferrite with silicon resin and have a 50%-particle size (D50) of 40 μm.

In this embodiment, in the developer container 41, the above-described toner and carrier are mixed in a mixing ratio of about 8:92 by weight to prepare a two component developer having a TD ratio (a weight ratio of toner to the entire developer) of 8%.

[Developer Supply (Replenishing) Mechanism]

Figure 3:
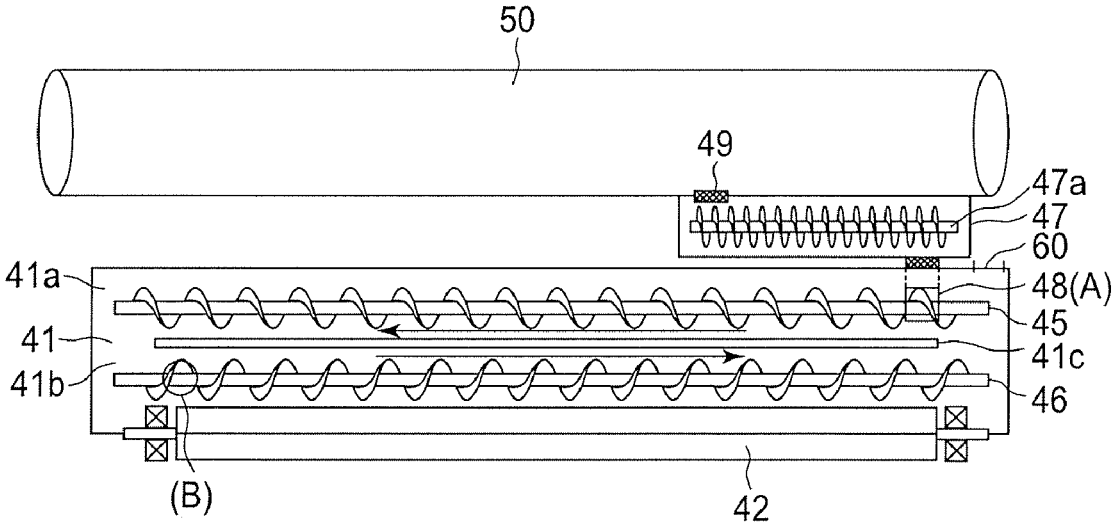
FIG. 3 illustrates a developer supplying mechanism provided in the image forming apparatus of FIG. 1.

Next, a developer supply mechanism in this embodiment will be described with reference to FIG. 3.

In this embodiment, the rotary developing apparatus 8 includes at least a developer supply mechanism (supply means) for supplying or replenishing at least the toner and the carrier, as supply developer, in a predetermined weight ratio to the developer container 41 of each of the developing devices 4. Further, the rotary developing apparatus 8 further includes a developer discharge mechanism for permitting discharge of the developer from the developer container 41 of each of the developing devices 4.

More specifically, when the toner is consumed by image formation, toner in an amount corresponding to the consumed amount of toner is supplied from a developer supply tank (toner bottle) 50. In this embodiment, the supply developer supplied from the developer supply tank 50 is a mixture of the toner and the carrier. As a result, it is possible to not only replenish toner in the amount corresponding to the consumed amount of toner but also supply fresh carrier in the developer container 41. The developer supply tank 50 is constituted so as to be detachably mountable to the image forming apparatus.

The developer supply mechanism includes the developer supply tank 50 and a buffer portion 47 located between the developer supply tank 50 and the developer container 41. Further, the developer supply mechanism includes an opening 49 for feeding the supply developer from the developer supply tank 50 to the buffer portion 47 and a supply opening for feeding the supply developer from the buffer portion 47 to the developer container 41. The developer supply mechanism further includes a supply member 47*a* for feeding the supply developer in the buffer portion 47. In this embodiment, the supply member 47*a* constitutes a supply developer conveyance means for conveying the supply developer to the developing device 4.

The supply member 47*a* is a rotatable screw (supply screw) in this embodiment and is driven depending on an amount of supply developer determined during image formation to supply the supply developer in a predetermined amount into the developer container 41.

Incidentally, the developer supply tank 50 may also include a conveyance member for conveying the supply developer. The developer supply tank 50 may, e.g., be provided with a screw-like member in a longitudinal direction thereof or helical projections at an inner wall thereof. The supply developer can be conveyed toward the opening 49 along the screw-like member or the helical projections by utilizing the rotation of the developing rotary 8A. It is also possible to drive the conveyance member, such as the screw-like member, itself provided in the developer supply tank 50. In this case, the conveyance member such as the screw-like member or the helical projections also constitutes the supply developer conveyance means.

The amount of the supply developer to be replenished may be determined according to any method. For example, it is possible to suitably use automatic toner replenishers (ATRs), known by the person skilled in the art, such as an inductance detection ATR, an optical detection ATR, a patch detection ATR, and a video count ATR. These ATRs may be used singly, all together, or a combination of two or more of these ATRs. More specifically, a toner concentration of the developer in the developer container 41 is directly detected by an inductance sensor for detecting permeability of the developer in the case of the inductance ATR or a reflection type optical sensor in the case of the optical detection ATR. Further, depending on a detection result, it is possible to determine a supply amount of the supply developer. Further, in the patch detection ATR, a predetermined reference toner image (patch image) is formed on the photosensitive drum (or the intermediary transfer member or the recording material) and its image density is detected, e.g., by the reflection type optical sensor. Then, a toner concentration of the developer in the developer container 41 is indirectly detected depending on a detection result by the optical sensor and depending on an indirect detection result, a supply amount of the supply developer can be determined. Further, in the video count ATR, an amount of usage of toner is calculated from an integrated value of density information of an image to be formed at each pixel and then a toner concentration of the developer in the developer container 41 is estimated. Depending on an estimation result, it is possible to determine a supply amount of the supply developer. In the present invention, a control method itself of the supply amount of the supply developer may be any method. More specifically, an available method may be appropriately selected and used.

When the fresh carrier is supplied into the developer container 41, an amount of developer present in the developer container 41 is correspondingly increased. However, a corresponding increment of the developer is discharged from a developer discharge opening 60 (FIG. 2) provided at a wall of the developer container 41. A position of the developer discharge opening 60 is adjusted so that an amount of the two component developer in the developer container 41 is stably kept at 375 g. In this embodiment, the discharged developer is collected by a collecting screw (not shown) provided at a center of the developing rotary 8A to be stored in a waste developer container (not shown). In this embodiment, a developer discharge mechanism is constituted by the developer discharge opening 60 and a waste developer conveyance means (not shown) for conveying the developer discharged from the developer discharge opening 60 to the waste developer container.

Hereinafter, the developer supply container 50 accommodating the yellow, magenta, cyan and black toners will be called a "non-transparent toner supply container", and the developer supply container 50 accommodating the transparent toner will be called a "transparent toner supply container".

The circulation of the developer in a developing container 41 will be described further. The inside of the developing container 41 is partitioned by a partition wall 41*c* into a stirring chamber (first chamber) 41*a* and a developer chamber (second chamber) 41*b*. At the opposite longitudinal end portions of the partition wall 41*c*, there are provided a communicating portion for communication with the stirring chamber 41*a* and the developer chamber 41*b*. In the stirring chamber 41*a*, there is provided a first stirring screw 45, and in the developer chamber 41*b*, there is provided a second stirring screw 46. The first stirring screw 45 and the second stirring screw 46 feed the developer in the opposite directions to each other. In this embodiment, as shown in FIG. 3, the first stirring screw 45 feeds the developer in the leftward direction, and the second stirring screw 46 feeds the developer in the rightward direction. By this, the developer in the stirring chamber 41*a* is fed into the developer chamber 41*b* through the communicating portion at one of the end of the partition wall 41*c*, and the developer in the developer chamber 41*b* is fed into the stirring chamber 41*a* through the communicating portion at the other end of the partition wall 41*c*. In this manner, the developer is fed and circulated in the developing container 41 by the first and second stirring screws 45, 46.

A supply opening 48 is provided adjacent to an upstream end of the stirring chamber 41*a* with respect to the developer feeding direction to let the supply developer to fall onto the first stirring screw 45 in the stirring chamber 41*a*. A discharge opening 60 is provided in the side wall of the developing container 41 at a position upstream of the supply opening 48 in the stirring chamber 1*a*.

The supply developer supplied into the stirring chamber 41*a* from the supply opening 48 is fed toward the developer chamber 41*b* while being stirred and mixed in the stirring chamber 41*a* with the already existing developer in the developing container 41. As a result, the supplied toner in the supply developer is sufficiently mixed with the developer in the developing container 41, and is triboelectrically charged. Then, it is supplied to the developing sleeve 42 in the developer chamber 41*b* to be used for development. The developer containing a decreased amount of the toner (due to the developing operation) is gradually discharged through the discharge opening 60 with the supply of the supply developer.

[CD Ratio of Supply Developer]

A description will be made as to setting of CD ratio (the weight ratio of the carrier on the basis of the total developer weight).

In this embodiment, the weight ratio, that is, CD ratio of the supply developer to be filled in the developer supply container 50 for the non-transparent toner and that for the transparent toner are made substantially equal to each other.

For example, the CD ratio of the supply developer in the supply container for the transparent toner is 15%, and the CD ratio in the supply containers for the non-transparent toner is also 15%. In such a case, when the initial total weight capacity of the developer supply container 50 is 400 g, 340 g of the toner and 60 g of the carrier are filled into the transparent toner supply container and also into the non-transparent toner supply container. Since an average image ratio of the output images is different depending on the users and ambient conditions of the image forming apparatus 100, the CD ratio of the supply developer can be adjusted.

As described hereinbefore, the developing operations are carried out for the respective colors to form a superimposed toner image comprising the yellow toner, the magenta toner, the cyan toner, the black toner and the transparent toner on the intermediary transfer belt 5.

In this embodiment, as has been described hereinbefore in conjunction with FIG. 4, (*a*) or FIG. 4, (*b*), the glossiness and the smoothness of the image are improved by overlaying the transparent toner in accordance with an amount of the non-transparent toner over the whole image formation area thus providing a uniform flat surface (uniform height of the superimposed toner images).

During the image forming operations, the supply developer is supplied into the developing container 41 with the consumption of the toners by the developing operation. In the case that transparent toner is deposited on the whole surface of the image formation area, the transparent toner may have to be supplied for each sheet, in a typical structure. For a continuous supply, the supply member 47*a* may have to be rotated continuously without stopping.

In such a case, if the flowability of the supply developer is low , toner agglomeration may be produced at the end of the supply member 47*a*.

In this embodiment, the supply developer contains not only the toner but also the carrier mixed therewith, so that flowability is enhanced. Therefore, the supply developer is continuously supplied with high flowability without stagnation at the end or the like of the supplying screw, and therefore, toner agglomeration does not occur.

In addition, by mixing the carrier particles in the supply developer, the charge amount of the toner at the time when the toner is supplied into the developing container 41 is high. By doing so, even if a large amount of the toner is supplied ,the charge amount is enough, until the supply toner is fed into the developing zone, to prevent toner scattering and to prevent production of a foggy background.

However, when the carrier ratio of the supply developer is too high, that is, the CD ratio is too high , the charge amount of the supply toner may be too large. The developing action continues until the energy balance is reached between the charge amount per unit mass of the toner and the potential difference formed between the developing sleeve 42 (developing potential) and the photosensitive drum 1 (the charged potential or the light portion potential). Therefore, the amount of the toner deposited on the photosensitive drum is determined by the potential difference and the toner charge amount.

When the potential difference is the same , the amount of toner deposition decreases with an increase of the charge amount of the toner, and on the contrary, the amount of the toner deposition increases with a decrease of the toner charge amount.

Therefore, if the CD ratio of the supply developer is too high, the amount of the toner deposition onto the photosensitive member decreases with the result of insufficient image density. Or, the quantity of the toner contained in one developer supply container 50 decreases with the result of high running costs.

On the contrary, if the CD ratio of the supply developer is too small, the flowability of the supply developer is not sufficient with the result of producing toner agglomeration.

The inventors' investigations taking the foregoing into account have revealed that CD ratio in the supply developer is preferably not less than 1% and not more than 50%. Further preferably, the CD ratio of the supply developer is not less than 10% and not more than 30%. In view of this, the CD ratio is 15% in this embodiment.

Figure 5:
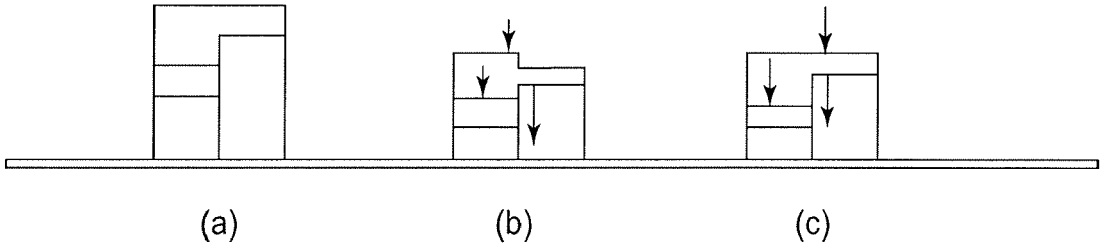
FIG. 5 illustrates images when the charge amount of the toner changes using the transparent toner.

With repeated consumption and supply of the toner, the charge amount of the toner in the developing device 4 varies. With the deviation of the charge amount of the toner from the predetermined level ,the amount of toner deposition deviates from the proper level. In order to solve this problem, it would be considered that variations of the charge amounts of the toners (including the transparent toner) are detected, in response to which the amounts of the toner depositions are controlled, by which the image is formed with uniform toner deposition amounts as shown in FIG. 5, (*a*). More particularly, an image is formed for the purpose of detecting the amount of toner deposition, by which the variation in the toner charge amount influential to the toner deposition amount can be detected.

However, if the variations of the toner charge amounts of the respective color toners are not uniform, the control of the toner deposition amounts is very difficult.

For example, it is assumed that CD ratios of the supply developers for the transparent toner and the chromatic toner A are 30%. It is further assumed that CD ratios of the supply developers for the chromatic toner B (the color is different from that of the toner A) are 10%.

In this case, the charge amounts of the supply developers for the transparent toner and the chromatic toner A are larger than that of the chromatic toner B. Therefore, charge amounts of the transparent toner and the chromatic toner A in the developing container 41 is larger than that of the chromatic toner B, and therefore, the toner deposition amount on the photosensitive drum tends to be insufficient.

On the contrary, the charge amount of the supply toner B (the CD ratio of the supply developer is 10%) is lower than that of the transparent toner and than that of the chromatic toner A, and therefore, the charge amounts of the toners in the developing container 41 are smaller, and the toner deposition amount on the photosensitive drum tends to be more than the proper level.

Thus, when different color toners (including the difference in transparency) have different CD ratios of the supply developers, the variation rates are different depending on the difference in the toner colors. For this reason, an image of a non-uniform toner deposition amount may be unintentionally formed as shown in FIG. 5, (*b*). This is because when the variation rates in the charge amounts of the toners are different, it is difficult to control the toner deposition amounts for the respective colors in accordance with the respective variations in the toner charge amounts.

In order to prevent the non-uniform (stepped) toner deposition amounts, it may be considered that charge amounts of the toners for the respective colors and the toner deposition amounts are detected for the respective colors. And, in accordance with the detection results, the adjustment of process condition for the image formation, the forced discharging/enforced stirring of the developer, and/or the like is carried out.

However, the formation of the image for the detection of the toner deposition is frequently carried out results in an increase of running costs, since such image formations do not provide any final print images.

It may be considered that detection of the toner deposition amount is carried out during the intervals between the image forming operations, but a down time is required for each of the toner deposition amount detections, and therefore, the productivity is remarkably reduced.

Accordingly, the frequent formation of the image for detecting the toner deposition amount in order to provide uniform toner deposition amount would not be practical, even if a uniform image can be provided.

In this embodiment, the CD ratios of the supply developers for the non-transparent toner and the transparent toner are the same (15%), so that difference in the variation rates of the toner charge amounts upon supply is removed.

That is, in this embodiment, the CD ratios of the supply developers including the transparent toner are all set to 15%. As a result, the variation rates of the toner charge amounts upon supply are practically the same including the transparent toner. For this reason, the image as shown in FIG. 5, (*c*), that is, substantially free from the step in the toner deposition amounts can be formed.

Since the variations in the toner charge amounts of all the toners are substantially the same, the toner charge amounts can be increased, and therefore, even if the toner deposition amount decreases as a whole, an unsmooth image does not occur. Or, the unsmoothness can be minimized into the acceptable range.

Therefore, even when the toner deposition amount is adjusted in response to the result of detection of the toner deposition amount in the image formed for the detection, the frequency of such detection image formations can be reduced, so that complication is remarkably reduced. The down time necessitated by such adjustment can be reduced.

In addition, when the CD ratios are different for the respective supply developers, the toner contents per unit supply developers are different, so that supply controls have to be carried out for the respective colors with the result of complication of the control system. According to this embodiment, however, the toner contents per unit supply developers are the same irrespective of color. Therefore, the developer supply control can be made common.

As described hereinbefore, according to this embodiment, the weight ratios of the carriers in the supply developers (CD ratios) to be supplied into the developer supply container 50 are substantially the same irrespective of whether it is the non-transparent toner or transparent toner.

Figure 6:
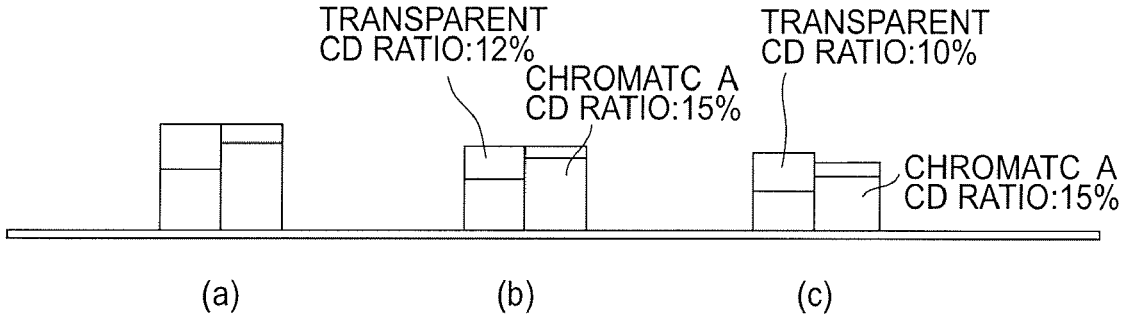
FIG. 6 is a schematic view illustrating the effects of the present invention.

Here, substantially the same of the CD ratio means the difference is within ±3%. That is, the absolute value of the difference is not more than 3%. Referring to FIG. 6, this will be described.

In the initial stage in which the developing operation is carried out by the two component developers already contained in the developing container 41 before the developer supply operation, the toner deposition amounts are uniform as shown in FIG. 6, (*a*). Investigations have been made with respect to the non-uniformness in the toner deposition amount when the toner consumption and toner supply are repeated with different conditions of the CD ratios of the supply developer between the transparent toner and the non-transparent toner.

Here, tests of repeated toner consumption and supply are such that images of 50% image ratio are formed intermittently with 100 continuous formations until 50000 images (sheets) while checking the non-uniformness of the toner deposition amounts for each of 5000 sheets. The toner consumption amount per image having the image ratio of 50% is approx. 0.25 g , and in accordance with such consumption amount, the toner is supplied. In addition to the toner supply depending on the image ratio, the toner deposition amount is detected periodically, so that toner deposition amount is kept within a proper range by supplying the proper amount of the developer. The non-uniformness (steps) are determined by measuring the surface roughness of the outputted images. For the measurement of the surface roughness, a surface roughness measuring device of the non-contact type is preferable to the surface roughness measuring device of the contact type since the image surface is not damaged. The unacceptable non-uniformness (steps) in the toner deposition amount is deemed in the case that detected surface roughness Rmax (JIS maximum height) of the output image exceeds 3 μm.

In a first case of the tests, the CD ratio of the supply developer for the transparent toner is 12%, and those for the non-transparent toners are 15%. The results of the tests of the first case show that output images are as shown in FIG. 6, (*b*), that is, there is no significant non-uniformness (steps) in the toner deposition amount. This is because the difference of the variation rates of the toner charge amounts upon supply depending on the colors is small.

In a second case of the tests, the CD ratio of the supply developer for the transparent toner is 10%, and those for the non-transparent toners are 15%. The results of the tests of the second case are such that output images are as shown in FIG. 6, (*c*), that is, there is slightly significant non-uniformness (steps) in the toner deposition amount.

In this manner, the acceptable CD ratio difference range have been investigated through repeated investigations and experiments. As a result, the non-uniformness in the toner deposition amount (steps) can be removed or can be reduced to an acceptable range by making the difference between the CD ratios of the supply developers for the non-transparent toners and the CD ratio of the supply developer for the transparent toner not more than ±3%.

Thus, according to this embodiment, the image formed using transparent toner can be substantially uniform In addition, in the case that non-transparent toner and the transparent toner are two-component developers, non-uniformness in the toner deposition amount (steps) can be prevented without complicated control. By such advantageous effects, a high glossiness color image having a color tone close to that of film photograph.

Embodiment 2

A developing device and an image forming apparatus according to a second embodiment of the present invention will now be described. The basic structures and operations of the developing device and the image forming apparatus are the same as those of Embodiment 1. In the description of this embodiment, the same reference numerals as in Embodiment 1 are assigned to the elements having the corresponding functions in this embodiment, and a detailed description thereof is omitted for simplicity.

As has been described with respect to Embodiment 1, non-uniformness (step) in the toner deposition amount is avoided or minimized by making the CD ratios of all of the supply developers substantially the same. According to this embodiment, the structure of the developing device 8 is such that non-uniformness reducing effect can be stabilized.

In this embodiment, the developing device including a developing device, a developer supply mechanism and a developer discharging mechanism is constituted taking into account the following points. A description will be made as to the case in which substantially the same amounts of the toners including the transparent toner are consumed and supplied.

The amounts of all of the developers in the developing devices 4, including the transparent toner, are substantially the same.

In addition, with respect to all of the toners including the transparent toner, the stirring properties and the feeding properties for the developers supplied from the developer supply mechanisms are the same in the range from the supply position 48 (A position) to one longitudinal end portion position of the developing sleeve 42 (the upstream end with respect to the feeding direction of the developer, B position). The sameness of the stirring and feeding properties for the developers here means that amounts of triboelectric charge applied from the A position to the B position to the respective toners are substantially the same. This can be accomplished by making the structures of the developing devices 4 substantially the same.

In addition, with respect to all of the toners including transparent toner, the structures of the supply paths from the supply openings 49 of the developer supply containers 50 to the supply openings 48 of the developing devices 4 through the supply members 47*a* of the buffers 47 are substantially the same. Thus, the feeding properties or performance of the supply developer feeding means for all the colors including the transparent toner are made substantially the same.

Similarly to Embodiment 1, the CD ratios of the supply developers are all 13% including the transparent toner.

With such a structure of the developing device, the following advantageous effects can be provided.

When the CD ratios are different for the respective supply developers, the toner contents per unit supply developers are different, so that supply controls have to be carried out for the respective colors with the result of complication of the control system. By making the CD ratios of the supply developers the same, the amounts of toners in the respective amounts of the supply developers are all the same. Therefore, the supply control can be made common. This is the same as with Embodiment 1. Furthermore, according to this embodiment, the structures of the developer supply mechanisms and the developing devices 4 may be substantially the same. By doing so, the amounts of the supply developers per unit time by the supply members 47*a* may be all the same. Therefore, according to this embodiment, the supply control for the developers may be common.

In addition, according to this embodiment, the influence of the charge amounts of the supply developers to the developers in the developing devices 4 can be made substantially the same, by making the developer amounts in the developing devices 4 substantially all the same and by making the stirring and feeding performance or properties substantially all the same in the range from the supply position of the developer supply mechanisms to the respective developer carrying members, including the transparent toner. By doing so, the difference in the variation rate can be reduced. Therefore, the image substantially without non-uniformness or with minimum non-uniformness can be provided as shown in FIG. 5, (*c*).

The advantageous effects are not limited to the case that substantially the same amount of the developers are consumed and supplied for all of the colors including the transparent toner but are similarly provided also in the case that image ratios are different, and therefore, the toner consumption amounts are different. The developing devices 4 are constituted such that CD ratios of the supply developers are the same and such that difference in the influence of the charge amount changes of the supplied developers is removed until the supplied developer reaches the developer carrying member. More particularly, in the case that stirring member is a screw type , the screw pitch may reduced, or the rib or the buffer plate may be provided to enhance the stirring power of the stirring member 45 at the supply opening side. Furthermore, by expanding the stirring member 45 in the length or by increasing the amount of developer at the supply opening side, the stirring power in the range to the developer carrying member can be enhanced to charge the toner to the sufficient extent and to mix the toner to the sufficient extent. By such enhancement of the stirring power at the supply opening side, the change of the charge amount of the developer by the supplying operation can be minimized.

As described in the foregoing, according to this embodiment, the CD ratios of the supply developers to be filled into the supply container for the transparent toner and that for the non-transparent toner are made substantially the same, and the stirring and feeding properties in the paths from the developer supply containers to the developer carrying members are the same in effect. As a result, the advantageous effects of Embodiment 1 can be provided more stably.

The specific structures of the embodiments are not limiting.

For example, in the foregoing embodiments, a rotation developing system is employed. However, the present invention is equally applicable to an image forming apparatus of a known in-line type.

Figure 7:
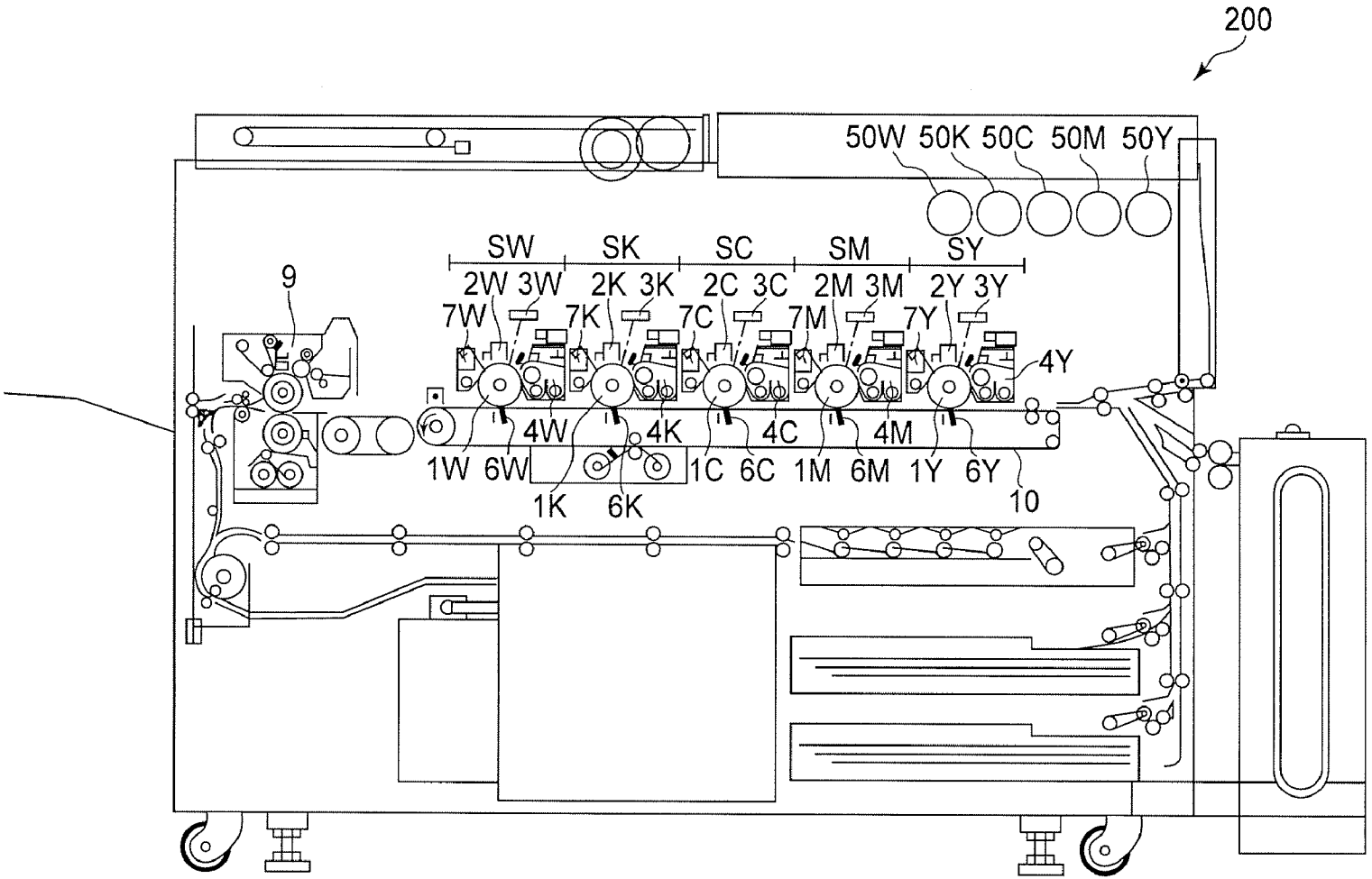
FIG. 7 is a schematic sectional view of an image forming apparatus according to another embodiment of the present invention.

FIG. 7 illustrates an example of the in-line type image forming apparatus. The image forming apparatus 200 shown in FIG. 7 comprises a plurality of image forming stations SY, SM, SC, SK, SW as the image forming means. The stations SY, SM, SC, SK, SW form yellow, magenta, cyan and black images using transparent toner. In the description of this example, the same reference numerals as in the foregoing embodiments are assigned to the elements having the corresponding functions in this embodiment, and the detailed description thereof is omitted for simplicity. They have substantially the same structures except for the color of the toner. Therefore, the reference characters Y, M, C, K and W are omitted in the following description.

In the image forming apparatus 200 of FIG. 7, the toner image formed on the photosensitive drum 1 in each of the stations S is sequentially transferred by a transfer member 6 (transferring means) onto a recording material P carried on a feeding belt (transfer belt, recording material feeding member) 10. As a result, in a full-color image formation, for example, the yellow, magenta, cyan, black and transparent toner images are superimposed into a superimposed toner image. The section of the superimposed toner image formed on the recording material P is similar to that of the foregoing embodiments. Thereafter, the recording material P is separated from the feeding belt 10 and is fed to a roller type fixing device 9. After the toner image is fixed a recording material P, it is discharged to the outside of the apparatus.

In such an in-line type image forming apparatus, similarly to the foregoing embodiments, the deposition amount of the transparent toner can be controlled so as to match the non-transparent toners by adjusting the CD ratios of the supply developer. As a result, a uniform image without seeped different in the toner deposition amounts can be stably outputted.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 015643/2006 filed Jan. 24, 2006 which is hereby incorporated by reference.

What is claimed is:

1. An image forming apparatus comprising:

first developing means for containing a first developer including a non-transparent toner and a carrier and for developing an electrostatic image with the first developer;

second developing means for containing a second developer including a transparent toner and a carrier and for developing an electrostatic image with the second developer;

first supplying means for containing a first supply developer including a non-transparent toner and a carrier and for supplying the first supply developer to said first developing means;

second supplying means for containing a second supply developer including a transparent toner and a carrier and for supplying the second supply developer to said second developing means; and control means for superimposing a toner image of the transparent toner on a non-transparent toner image so as to reduce a height difference in a toner layer or layers of the toner image provided by the non-transparent toner, wherein a carrier weight ratio of the first supply developer and a carrier weight ratio of the second supply developer are substantially equal to each other, wherein the carrier weight ratio of the first developer contained in the first developing means is different from the carrier weight ratio of the first supply developer contained in the first supply means, and wherein the carrier weight ratio of the second developer contained in the second developing means is different from the carrier weight ratio of the second supply developer contained in the second supply means.

2. An apparatus according to claim 1, wherein there are provided a plurality of said first developing means each of which uses the first developer having different colors, respectively, wherein there are provided a plurality of said first supplying means each of which contains the first supply developer having different colors, respectively, and wherein all of the carrier weight ratios of the first supply developers having different colors are substantially the same as the carrier weight ratio of the second supply developer.

3. An apparatus according to claim 1, wherein the carrier weight ratios of the first supply developer and of the second supply developer are not less than 1% and not more than 50%.

4. An apparatus according to claim 1, wherein said first developing means and said second developing means include respective developing members for supplying the first developer and the second developer to the electrostatic images and respective stirring and feeding members for stirring and feeding the first developer and the second developer, and a triboelectric charge application performance of said stirring and feeding member for said first developing means in a range from a supply position where the first supply developer is supplied to said developing member is substantially the same as a triboelectric charge application performance of said stirring and feeding member for said second developing means in a range from a supply position where the second supply developer is supplied to said developing member.

5. An apparatus according to claim 1, wherein each of said first supplying means and said second supplying means includes a feeding member for feeding the first supply developer and the second supply developer, respectively, to an associated developing means, and a triboelectric charge application performance of said feeding member in said first supplying means is the same as a triboelectric charge application performance in said second supplying means.

6. An apparatus according to claim 1, wherein an absolute value of a difference between a carrier weight ratio of the first supply developer contained in said first supplying means and the second supply developer contained in said second supplying means is not more than 3%.

* * * * *